US007961162B2

(12) United States Patent
Kubo et al.

(10) Patent No.: US 7,961,162 B2
(45) Date of Patent: Jun. 14, 2011

(54) LIQUID CRYSTAL DISPLAY DEVICE

(75) Inventors: Chikae Kubo, Mobara (JP); Naoki Tokuda, Mobara (JP)

(73) Assignee: Hitachi Displays, Ltd., Chiba-ken (JP)

( * ) Notice: Subject to any disclaimer, the term of this patent is extended or adjusted under 35 U.S.C. 154(b) by 763 days.

(21) Appl. No.: 11/634,263

(22) Filed: Dec. 6, 2006

(65) Prior Publication Data

US 2007/0139341 A1 Jun. 21, 2007

(30) Foreign Application Priority Data

Dec. 20, 2005 (JP) ..... 2005-366348

(51) Int. Cl.
*G09G 3/36* (2006.01)

(52) U.S. Cl. ..... 345/87; 345/88

(58) Field of Classification Search ..... None
See application file for complete search history.

(56) References Cited

U.S. PATENT DOCUMENTS

| | | | | |
|---|---|---|---|---|
| 7,505,018 | B2 * | 3/2009 | Feng et al. | 345/89 |
| 2005/0122295 | A1 * | 6/2005 | Sawabe | 345/88 |
| 2005/0162360 | A1 * | 7/2005 | Ishihara et al. | 345/89 |
| 2007/0018939 | A1 * | 1/2007 | Chen et al. | 345/100 |

FOREIGN PATENT DOCUMENTS

JP 2004-212747 1/2003

* cited by examiner

*Primary Examiner* — Bipin Shalwala
*Assistant Examiner* — Daniel Bedell
(74) *Attorney, Agent, or Firm* — Stites & Harbison PLLC; Juan Carlos A. Marquez, Esq.

(57) ABSTRACT

In a liquid crystal display device, both of the brightness characteristic and the chromaticity characteristic are set to optimum values. In the liquid crystal display device which includes a liquid crystal display panel, a data driver, a scanning driver and a display control circuit, the display control circuit includes a first circuit which generates insertion display data which differs from the image display data and inserts the display data into the data driver, and a second circuit which sets a first time at which the scanning signal for displaying the display data and a second time at which the scanning signal for displaying the insertion display data are outputted. The first circuit generates display data of one chromatic color and, at the same time, sets gradations of chromatic color for every frame period.

2 Claims, 15 Drawing Sheets

LIQUID CRYSTAL DISPLAY DEVICE

The present application claims priority from Japanese application JP2005-366348 filed on Jul. 8, 2005, the content of which is hereby incorporated by reference into this application.

BACKGROUND OF THE INVENTION

1. Field of the Invention

The present invention relates to a liquid crystal display device, and more particularly to a technique which is effectively applicable to a liquid crystal display device which displays image display data and another display data during 1 frame period.

2. Description of the Related Art

Conventionally, in classifying the display device from a viewpoint of a motion picture display, the display device is roughly classified into an impulse-response-type display device and a hold-response-type display device. The impulse-response-type display device is a display device of a type in which the brightness response is lowered immediately after scanning such as the light retention characteristic of a cathode ray tube, for example. On the other hand, the hold-response-type display device is, for example, a display device of a type which keeps holding of the brightness based on image display data until next scanning.

The hold-response-type display device can, when a still image is displayed, obtain a favorable display quality with no flickering. However, on the other hand, when a motion picture is displayed, a phenomenon that a periphery of an object which moves is blurred, that is, motion picture blurring occurs thus giving rise to a drawback that display quality is remarkably lowered.

As a method for reducing the motion picture blurring in the hold-response-type display device, for example, there has been known a method in which at the time of displaying the motion picture, black display data is inserted during each frame period (see JP-A-2004-212747 (patent document 1), for example).

SUMMARY OF THE INVENTION

However, in the method described in the patent document which inserts the black display data, there has been a drawback that it is difficult to set both of brightness characteristic and chromaticity characteristic of the display device to optimum values. This drawback is simply explained in conjunction with FIG. 14 and FIG. 15 by taking a liquid crystal display device which constitutes one of the hold-response-type display devices as an example.

The liquid crystal display device is a display device which controls the orientation of liquid crystal molecules by applying an electric field to a liquid crystal material sealed between a pair of substrates thus displaying images. Further, in classifying the liquid crystal display device from a viewpoint of the direction of an electric field which is applied to the liquid crystal material, the liquid crystal display device is roughly classified into a vertical-electric-field type liquid crystal display device such as a VA-type liquid crystal display device and a lateral-electric-field type liquid crystal display device such as an IPS-type liquid crystal display device.

Here, the relationship between the retardation (birefringence phase difference) Δnd and the transmissivity of a liquid crystal material is expressed as shown in FIG. 14. That is, in case of the IPS-type liquid crystal display device, by setting the retardation Δnd to a value which falls within a range from 0.32 to 0.34, the transmissivity assumes a maximum value. Further, in case of the VA-type liquid crystal display device, by setting the retardation Δnd to a value which falls within a range from 0.38 to 0.40, the transmissivity assumes a maximum value.

On the other hand, the relationship between the retardation Δnd and the chromaticity of a liquid crystal material is expressed as shown in FIG. 15, for example. FIG. 15 is an xy chromaticity chart and shows, in the IPS-type liquid crystal display device, the relationship between the retardation Δnd and an x value and a y value of the chromaticity when the black display data is inserted as described in the patent document 1.

It is preferable to set the chromaticity characteristic of the liquid crystal display device, that is, the x value and the y value in the xy chromaticity chart to values which fall within a range of a target region TA indicated by a broken line shown in FIG. 15, for example. However, when the retardation Δnd is set to a value which falls within a range from 0.32 to 0.34 such that the transmissivity assumes a maximum value in the IPS-type liquid crystal display device, for example, the chromaticity characteristic falls outside the target region TA and blue tinge is strengthened. To the contrary, in an attempt to set the chromaticity characteristic within the target region TA, the retardation Δnd is decreased and hence, the transmissivity is lowered. Accordingly, in the conventional liquid crystal display device, it is impossible to maximize the brightness characteristic and, at the same time, to set the chromaticity characteristic to fall within the target region TA.

Accordingly, it is an object of the present invention to provide a technique which can set both of brightness characteristic and chromaticity characteristic to optimum values in a liquid crystal display device, for example.

The above-mentioned and other objects and novel features of the present invention will become apparent from the description of this specification and attached drawings.

To explain the summary of typical inventions among the inventions disclosed in this specification, they are as follows.

(1) In a liquid crystal display device which includes a liquid crystal display panel in which a plurality of data signal lines and a plurality of scanning signal lines are arranged in a matrix array and which forms a region surrounded by two neighboring data signal lines and two neighboring scanning signal lines into one pixel region, a data driver which outputs a display signal to the data signal lines, a scanning driver which outputs a scanning signal to the scanning signal lines, and a display control circuit which transmits a control signal for controlling outputting of the display signal of the data driver and the display signal to the data driver and, at the same time, a control signal which controls the outputting of the scanning signal of the scanning driver to the scanning driver, the display control circuit includes a first circuit which divides image display data inputted from an external device for every 1 frame period and generates insertion display data which differs from the image display data in the image display data of each frame period and transmits the display data to the insertion data driver by insertion, and a second circuit which sets a first time at which the scanning signal which displays the display data is outputted to the respective scanning signal lines and a second time at which the scanning signal which displays the insertion display data is outputted to the respective scanning signal lines, and the first circuit generates one chromatic color display data and, at the same time, sets gradations of chromatic color for every frame period.

(2) In the above-mentioned means (1), a circuit which sets gradations of chromatic colors sets the gradations based on an average gradation of the image display data which id displayed in every frame period.

(3) In the above-mentioned means (2), a circuit which sets gradations of chromatic colors increases the gradation of the insertion display data when the average gradation is high, and decreases the gradation of the insertion display data when the average gradation is low.

(4) In a liquid crystal display device which includes a liquid crystal display panel in which a plurality of data signal lines and a plurality of scanning signal lines are arranged in a matrix array and which forms a region surrounded by two neighboring data signal lines and two neighboring scanning signal lines into one pixel region, a data driver which outputs a display signal to the data signal lines, a scanning driver which outputs a scanning signal to the scanning signal lines, and a display control circuit which transmits a control signal for controlling outputting of the display signal of the data driver and the display signal to the data driver and, at the same time, a control signal which controls the outputting of the scanning signal of the scanning driver to the scanning driver, the display control circuit includes a first circuit which divides the image display data inputted from an external device for every 1 frame period and generates insertion display data which differs from the video data image in the image display data of each frame period and transmits the display data to the insertion data driver by insertion, and a second circuit which sets a first time at which the scanning signal which displays the display data is outputted to the respective scanning signal lines and a second time at which the scanning signal which displays the insertion display data is outputted to the respective scanning signal lines, and the first circuit generates one chromatic color display data, and the second circuit sets an interval between the first time and the second time for every frame period.

(5) In the above-mentioned means (4), the circuit which sets the interval between the first time and the second time sets the interval based on an average gradation of the image display data displayed in every frame period.

(6) In the above-mentioned means (5), the circuit which sets the interval between the first time and the second time is prolonged when the average gradation is high and shortens the interval when the average gradation is low.

(7) In the above-mentioned means (1) or (4), the first circuit generates and inserts blue insertion display data.

The liquid crystal display device of the present invention, for example, as in the case of the above-mentioned means (1), when two display data consisting of the image display data and the insertion display data are displayed in 1 frame period, the insertion display data of chromatic color is inserted and displayed. Here, with respect to the insertion display data, the gradation is set for every frame period. The gradation of the insertion display data in every frame period is, as in the case of the above-mentioned means (2), set based on the average gradation of the image display data displayed in each frame period. To be more specific, as in the case of the means (3), when the gradation of the insertion display data is increased when the average gradation is high, and the gradation of the insertion display data is decreased when the average gradation is low.

Here, it is preferable to set the color of the insertion display data to blue as in the case of the means (7).

In such a liquid crystal display device, by inserting the above-mentioned insertion display data in every frame period, the motion picture blurring can be reduced. Further, by adopting chromatic insertion display data such as blue insertion display data as the insertion display data, for example, the distribution of the retardation Δnd in the xy chromaticity chart differs from the corresponding distribution in case of black. That is, when the insertion display data is of chromatic color such as blue, the x value and the y value with the retardation Δnd which brings about the maximum transmissivity to the liquid crystal display device are distributed within the preferable chromaticity characteristic. Accordingly, it is possible to set both of the brightness characteristic and the chromaticity characteristic of the liquid crystal display device to optimum values.

Further, in setting the gradations of the insertion display data based on the average gradation of the image display data, for example, the gradation of the average gradation and the insertion display data may be set to the one-to-one relationship or h-to-one relationship (h: integer of 2 or more).

Further, in place of changing the gradation of the insertion display data based on the image display data displayed in every frame period as in the case of the above-mentioned means (1) to means (3), for example, as in the case of the means (4), the insertion period of the insertion display data may be changed by changing the interval of the first time and the second time for every frame period. Also in this case, the interval of the first time and the second time is set based on the average gradation of the image display data in each frame period as in the case of the means (5). To be more specific, as in the case of the means (6), the interval is prolonged when the average gradation is high and the interval is shortened when the average gradation is low.

Also in this case, it is preferable to set the color of the insertion display data to blue, for example, as in the case of the above-mentioned means (7).

Also in such a liquid crystal display device, the motion picture blurring can be reduced by inserting the above-mentioned insertion display data in each frame period. Further, when the insertion display data is of chromatic color such as blue, for example, the distribution of the retardation Δnd in the xy chromaticity chart differs from the corresponding distribution in case of black. That is, when the insertion display data is of chromatic color such as blue, the x value and the y value with the retardation Δnd which brings about the maximum transmissivity to the liquid crystal display device are distributed within the preferable chromaticity characteristic. Accordingly, it is possible to set both of the brightness characteristic and the chromaticity characteristic of the liquid crystal display device to optimum values.

Further, in the above-mentioned means (1) to means (3), both of the brightness characteristic and the chromaticity characteristic are set to optimum values by changing gradations of the insertion display data. On the other hand, in the above-mentioned means (4) to means (6), both of the brightness characteristic and the chromaticity characteristic are set to optimum values by changing the length of the insertion period of the insertion display data. However, the liquid crystal display device of the present invention may change both of them, that is, the gradation and the insertion period of the insertion display data for every frame period.

PREFERRED EMBODIMENTS OF THE INVENTION

The present invention is described in detail hereinafter in conjunction with embodiments by reference to drawings.

Here, in all drawings for explaining the embodiments, same symbols are used to indicate parts having identical functions and their repeated explanation is omitted.

Figure 1:
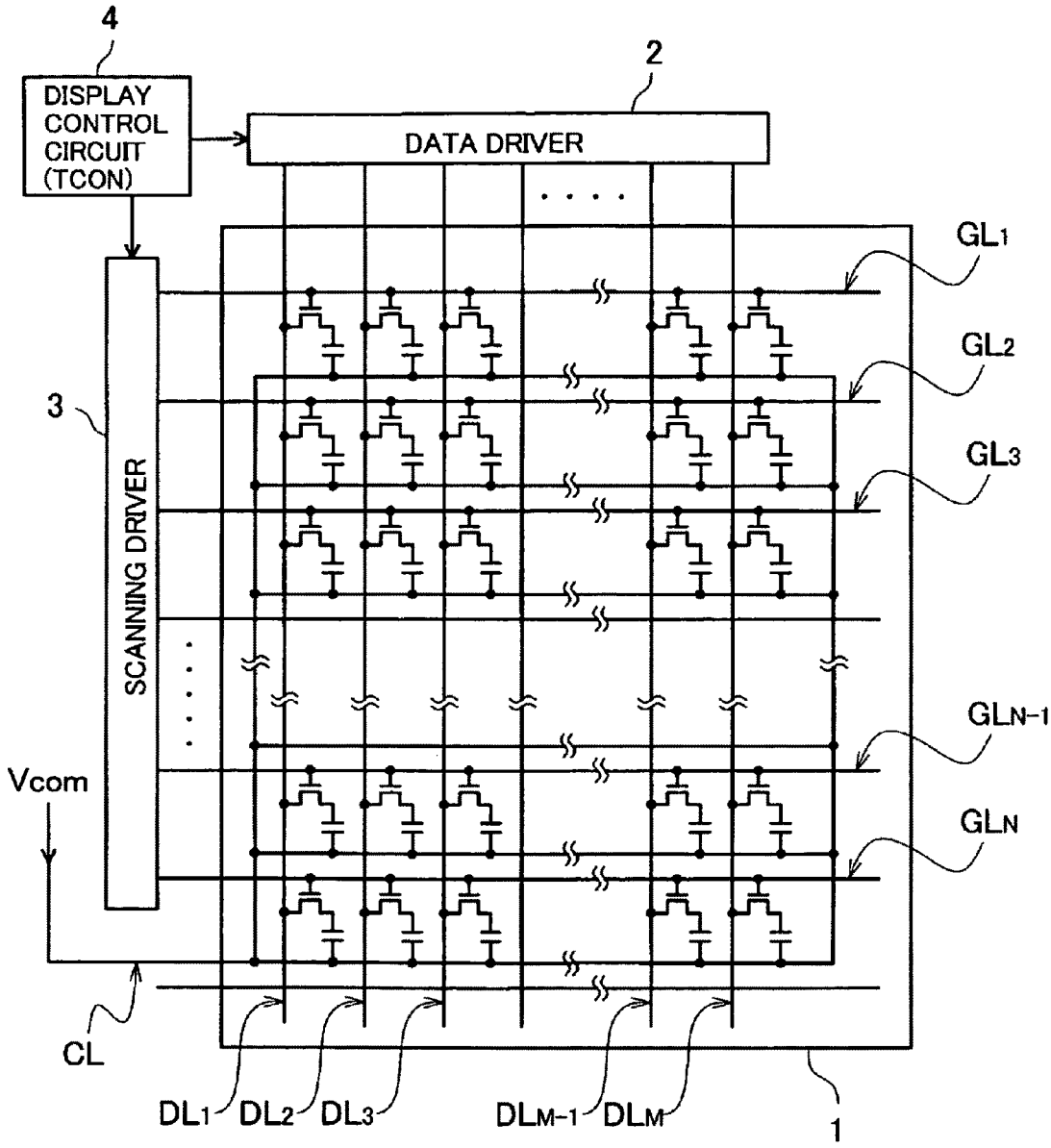
FIG. 1 is a schematic view showing the schematic constitution of a liquid crystal display device according to the present invention and also is a circuit block diagram showing an overall constitutional example.
Figure 2:
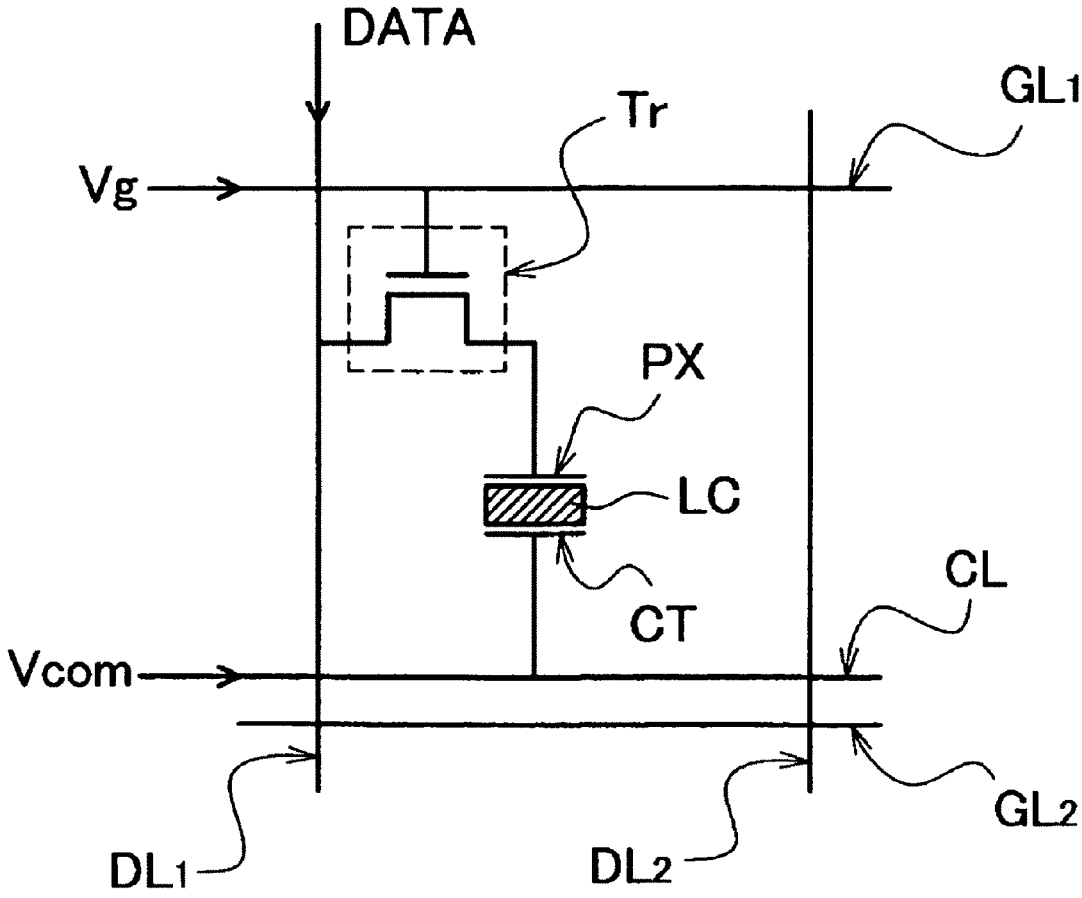
FIG. 2 is a schematic view showing the schematic constitution of the liquid crystal display device according to the present invention and also is a circuit diagram showing a constitutional example of one pixel.

FIG. 1 and FIG. 2 are schematic views showing the schematic constitution of a liquid crystal display device according to the present invention, wherein FIG. 1 is a circuit block diagram showing an overall constitutional example of the present invention and FIG. 2 is a circuit diagram showing a constitutional example of one pixel.

The liquid crystal display device according to the present invention includes, for example, as shown in FIG. 1, a liquid crystal display panel 1 on which M pieces of data signal lines $DL_m$ (m=1, 2, . . . , M) and N pieces of scanning signal lines $GL_n$ (n=1, 2, . . . , N) are arranged in a matrix array, a data driver 2 which outputs a display data signal to the data signal lines $DL_m$, a scanning driver 3 which outputs a scanning signal to the scanning signal lines $GL_n$, and a display control circuit 4 which transmits the display data signal and a control signal for controlling the outputting of the display data signal to the data driver 2 and, at the same time, transmits a control signal for controlling the outputting of the scanning signal to the scanning driver 3.

Here, a subscript m of the data signal line $DL_m$ and a subscript n of the scanning signal line $GL_n$ are subscripts which are respectively provided to distinguish the plurality of signal lines. Accordingly, in the following explanation, the subscripts are added only when it is necessary to distinguish the respective signal lines, while in other cases, the signal lines are simply referred to as the data signal lines DL and the scanning signal lines GL.

The liquid crystal display panel 1 is a display panel in which a liquid crystal material is sealed between a pair of substrates, wherein a region surrounded by the neighboring two data signal lines DL and the neighboring two scanning signal lines GL constitute one pixel region. The constitution and an operational principle of the pixel region are explained in conjunction with FIG. 2. Here, FIG. 2 shows a constitutional example of the pixel region surrounded by the first data signal line $DL_1$, the second data signal line $DL_2$, the first scanning signal line $GL_1$, and the second scanning signal line $GL_2$.

In the above-mentioned pixel region, for example, as shown in FIG. 2, a TFT element Tr, a pixel electrode PX and a common electrode CT are arranged. Here, the TFT element Tr has a gate electrode thereof connected to the scanning signal line $GL_1$, a drain electrode thereof connected to the data signal line $DL_1$, and a source electrode thereof connected to the pixel electrode PX. Further, the liquid crystal display panel 1 includes a common signal line CL which supplies a common electrode Vcom to the pixel electrode PX. Still further, a capacitor element is formed between the pixel electrode PX and the common electrode CT which is connected to the common signal line CL.

In displaying a video (an image) on the liquid crystal display panel 1, for example, display data signals DATA (graduation voltage signals) are outputted to the respective data signal lines DL. Further, in synchronism with timing of outputting the display data which is displayed in the respective pixel regions, the scanning signals are outputted to the scanning signal lines GL. Here, in the TFT element which is connected to the scanning signal line GL to which the scanning signals are outputted, the gate electrode assumes an ON state so that the display data signals DATA which are outputted to the data signal line DL are written in the TFT element. Further, the orientation of the liquid crystal molecules of the liquid crystal layer LC is controlled by the change of an electric field generated based on the potential difference between the pixel electrode PX and the common electrode CT. In the pixel region shown in FIG. 2, when the scanning signal is outputted to the first scanning signal line $GL_1$, the display data signal DATA which is outputted to the first data signal line $DL_1$ is written in the TFT element Tr.

Figure 3:
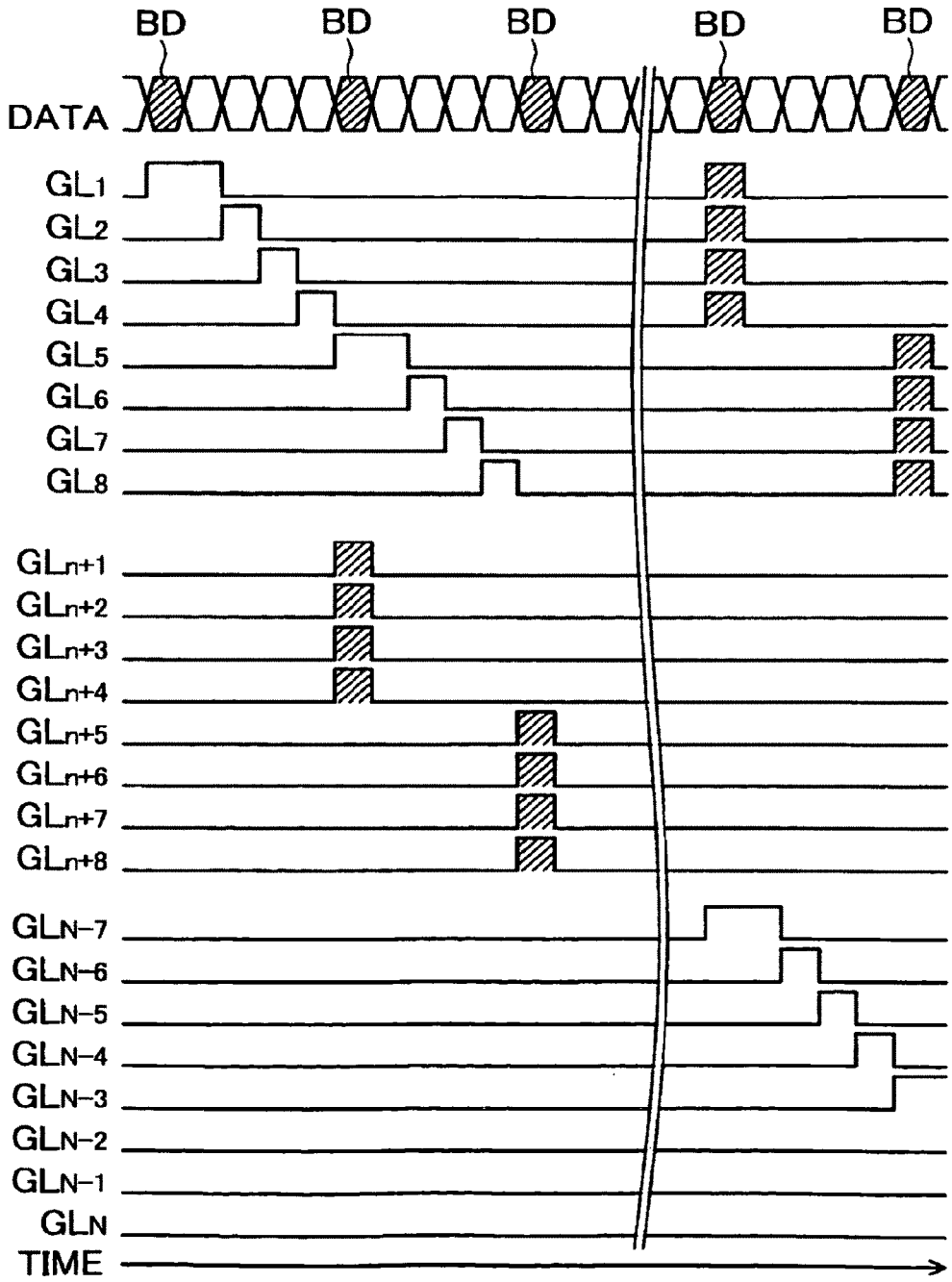
FIG. 3 is a schematic view for explaining an operational principle of the liquid crystal display device according to the present invention and also is a schematic view showing an output timing of a scanning signal.
Figure 4:
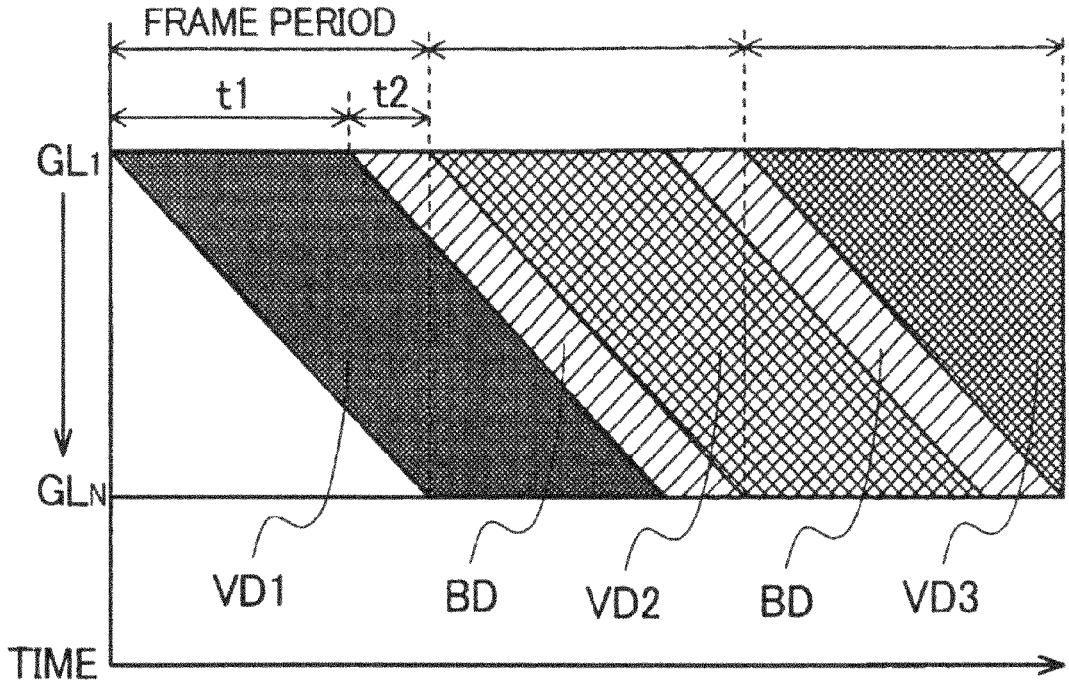
FIG. 4 is a view for explaining an operational principle of the liquid crystal display device according to the present invention and also is a schematic view showing image display timing for every frame period.

FIG. 3 and FIG. 4 are schematic views for explaining the operational principle of the liquid crystal display device according to the present invention, wherein FIG. 3 is a schematic view showing the output timing of the scanning signal and FIG. 4 is a graph showing the image display timing for every frame period.

In displaying an image on the liquid crystal display device according to the present invention, for example, as shown in FIG. 3, the display data signal DATA is outputted from the data driver 2 to the respective data signal lines DL. Here, by numbering the respective scanning signal lines GL with 1, 2, 3, . . . , N in order from the scanning signal line arranged closer to the data driver 2, in response to the display data signals DATA, image display data are sequentially outputted at a fixed cycle from image display data to be displayed in the pixel having the TFT element Tr connected to the scanning signal line $GL_1$. Also in this case, the scanning driver 3 outputs the scanning signals in order from the scanning signal line $GL_1$ in conformity with an output cycle of the above-mentioned display data signal DATA.

Further in this case, for example, the data driver 2 generates the display data signal DATA by inserting insertion display data BD into the image display data inputted from an external device and outputs the display image data DATA to the respective signal lines DL. In conventional liquid crystal display devices, the insertion display data BD is, for example, formed of display data which is black or dark gray color close to black. Further, the scanning driver 3 outputs, at the timing that the insertion display data BD is outputted to the data signal lines DL, a scanning signal which displays the insertion display data BD (hereinafter, referred to as the insertion scanning signal) to the scanning signal line which is different from the scanning signal line GL for outputting a scanning signal which displays the above-mentioned image display data (hereinafter, referred to as an image scanning signal).

Further, when the insertion scanning signal is outputted, for example, the insertion scanning signal is outputted to a plurality of scanning signal lines simultaneously. In an example shown in FIG. 3, the insertion scanning signal is outputted to four continuous scanning signal lines GL collectively.

In displaying the video (the image) in such a manner, for example, as shown in FIG. 4, at the beginning of each frame period, the image scanning signal is outputted to the first scanning signal line $GL_1$ so that the image display data is written in the respective pixels along the first scanning signal line $GL_1$ to display the image display data. Thereafter, image scanning signals are outputted at predetermined timings sequentially from the second scanning signal line $GL_2$ to the Nth scanning signal line $GL_N$ so that the image display data is written in the respective pixels along the respective scanning signal lines $GL_2$ to $GL_N$ to display the image display data. Then, at a point of time that the image display data is displayed at the respective pixels along the Nth scanning signal line $GL_N$, image display data VD1, VD2, and VD3 amounting to 1 frame period are displayed on the whole area of the display region of the liquid crystal display panel 1.

Here, to the first scanning signal line $GL_1$, after a lapse of the period t1 which is shorter than one frame period from a point of time that the image scanning signal is outputted, the insertion scanning signal is outputted, the insertion display data BD is written in the respective pixels along the first scanning signal line $GL_1$ and the display data is displayed. Thereafter, in the period t2 which lasts until a point of time that the image scanning signal for the next frame period is outputted, the insertion display data BD is displayed. In the same manner, from the second scanning signal line $GL_2$ to the Nth scanning signal line $GL_N$, after a lapse of the period t1 which is shorter than one frame period from a point of time that the image scanning signal is outputted, the insertion scanning signal is outputted so that the insertion display data BD is written in the respective pixels along the respective scanning signal lines $GL_2$ to $GL_N$ and the insertion display data BD is displayed during only the period t2.

Here, in outputting the insertion scanning signal to the scanning signal lines GL, for example, as shown in FIG. 3, the insertion scanning signal is outputted to a plurality of the scanning signal lines collectively. Accordingly, although the actual period for displaying the insertion display data BD differs between the respective scanning signal lines GL, the difference among the periods is very small and hence, the period for displaying the substantial insertion display data BD is assumed to be equal to the period t2 in which the pixels arranged along the first scanning signal line $GL_1$ display the insertion display data BD.

In this manner, by displaying the insertion display data BD only for the period t2 within the respective frame periods, the motion picture blurring can be decreased.

However, in the conventional liquid crystal display devices, in displaying the image in this manner, the period t1 in the respective frame periods is always fixed. Further, the insertion display data BD is, as shown in the above-mentioned patent document 1 (Japanese Paten Laid-open 2004-212747), for example, black or dark gray close to black. Still further, the insertion display data BD always possesses the fixed gradation regardless of the brightness of the image display data displayed in the respective frame periods. Accordingly, for example, as explained in conjunction with FIG. 14 and FIG. 15, it is difficult to optimize both of brightness characteristic and chromaticity characteristic.

In view of the above, in the liquid crystal display device according to the present invention, by adopting the insertion display data BD of chromatic color and, at the same time, by changing the gradation or the display period t2 of the insertion display data in accordance with the brightness of the image display data BD which is displayed in the respective frame periods, the motion picture blurring is decreased and both of the brightness characteristic and the chromaticity characteristic can be optimized.

Embodiment 1

Figure 5:
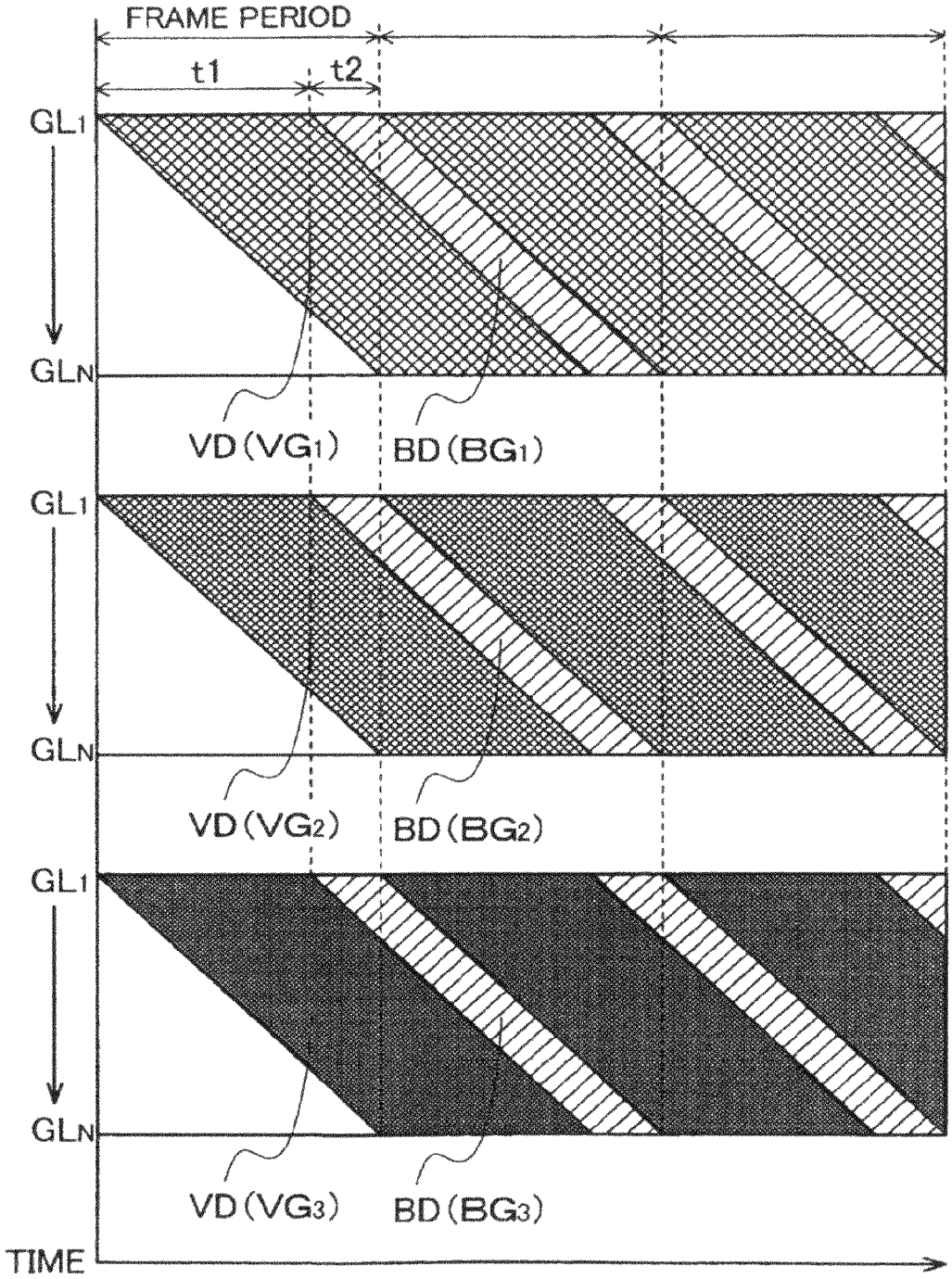
FIG. 5 is a schematic view for explaining a display method of the liquid crystal display device of an embodiment 1 according to the present invention and also is a view showing image display timing for every frame period for explaining a principle of the embodiment 1.
Figure 6:
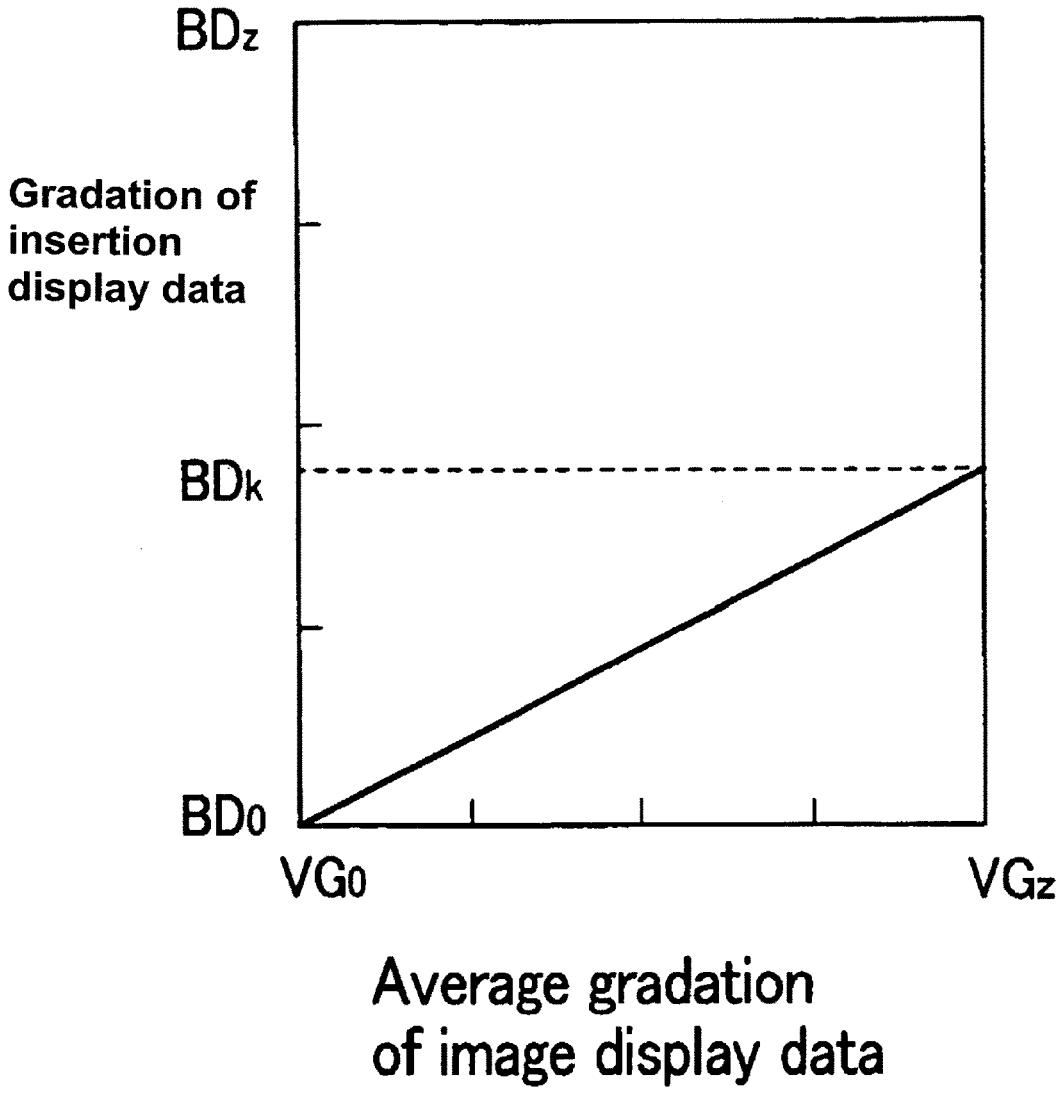
FIG. 6 is a schematic view for explaining a display method of the liquid crystal display device of an embodiment 1 according to the present invention and also is a view showing an example of a method for setting gradation of insertion display data.
Figure 7:
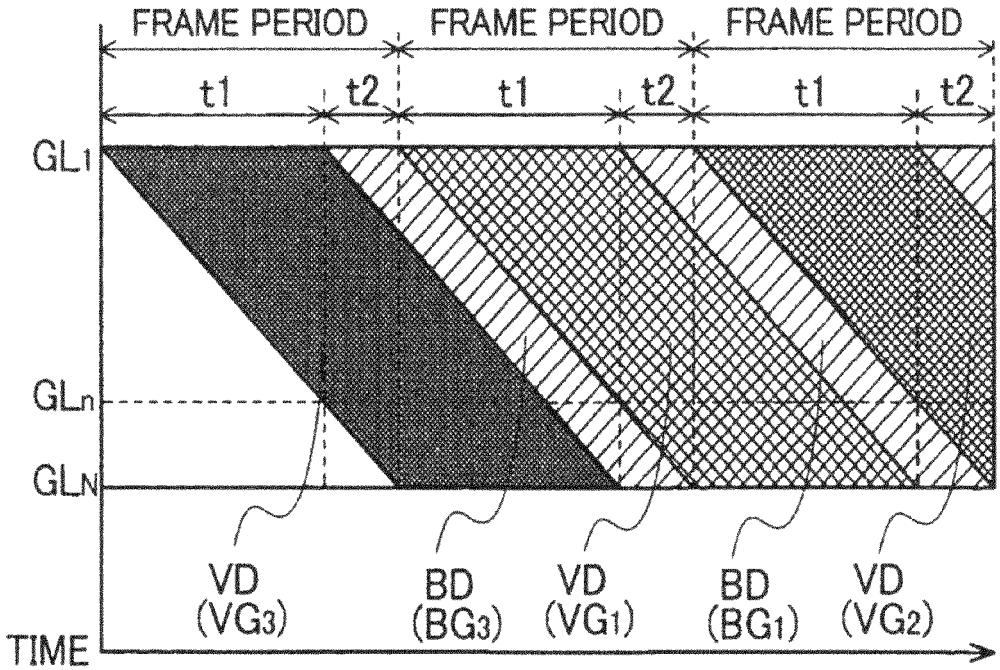
FIG. 7 is a schematic view for explaining a display method of the liquid crystal display device of an embodiment 1 according to the present invention and also is a view showing an example of image display timing for every frame period when an image is actually displayed.

FIG. 5 to FIG. 7 are schematic views for explaining the display method of the liquid crystal display device of an embodiment 1 according to the present invention, wherein FIG. 5 is a graph showing the image display timing for every frame period for explaining the principle of the embodiment 1, FIG. 6 is a graph showing an example of a method for setting the insertion display data gradation, and FIG. 7 is a graph showing an example of the image display timing for every frame period when an image is actually displayed.

The display method of the embodiment 1 is a display method which can decrease the motion picture blurring and, at the same time, can optimize both of the brightness characteristic and the chromaticity characteristic by adopting the blue insertion display data BD and, by setting the gradation of the insertion display data BD for every frame period, Here, the gradation of the insertion display data BD is, for example, as shown in FIG. 5, changed in response to the brightness of the image display data VD displayed for every display period, to be more specific, the average gradation of the image display data VD for every display period. Here, in FIG. 5, three image display timings for every frame period are shown in parallel in the vertical direction, wherein an upper portion of FIG. 5 indicates the image display timing when the average gradation of the image display data VD is $VG_1$, an intermediate portion of FIG. 5 indicates the image display timing when the average gradation of the image display data VD is $VG_2$, and a lower portion of FIG. 5 indicates the image display timing when the average gradation of the image display data VD is $VG_3$.

In the display method of the embodiment 1, for example, when the average gradation of the image display data VD is $VG_1$, the gradation of the insertion display data BD is set to $BG_1$. Further, when the average gradation of the image display data VD is $VG_2$, the gradation of the insertion display data BD is set to $BG_2$. Still further, when the average gradation of the image display data VD is $VG_3$, the gradation of the insertion display data BD is set to $BG_3$.

Further in this case, when the average gradation of the image display data VD is high, the gradation of the insertion display data BD is increased, while when the average gradation of the image display data VD is low, the gradation of the insertion display data BD is decreased. That is, in the example shown in FIG. 5, when the average gradation of the image display data VD is set to the relationship of $VG_1>VG_2>VG_3$, the gradation of the insertion display data BD is set to satisfy the relationship of $BG_1>BG_2>BG_3$.

Further, in FIG. 5, although the case in which three average gradations of the image display data VD are adopted is illustrated, in an actual operation, the number of average gradations corresponding to the number of displayable gradations exists. Accordingly, the average gradation of the image display data VD and the gradation of the insertion display data BD are, for example, defined by the relationship shown in FIG. 6. In a graph shown in FIG. 6, the average gradation of the image display data VD displayed in one frame period is taken on an axis of abscissas and the gradation of the insertion display data BD is taken on an axis of ordinates.

Assuming that the respective pixels of the liquid crystal display device can perform the display of Z+1 gradations, the average gradation of the image display data VD exhibits any one of the gradations VGz (z=0, 1, 2, . . . , Z). Accordingly, for example, as shown in FIG. 6, when the average gradation of the image display data VD assumes the smallest gradation ($VG_0$), the gradation of the insertion display data BD is set to $BG_0$, while when the average gradation of the image display data VD assumes the largest gradation (VGz), the gradation of the insertion display data BD is set to $BG_K$. Further, by changing the gradation of the insertion display data BD linearly within a range from $BG_0$ to $BG_K$, when the average gradation VG of the image display data VD is high, the gradation BG of the insertion display data BG is increased, while when the average gradation VG of the image display data VD is low, the gradation BG of the insertion display data BD is decreased.

Further, the gradation $BG_K$ of the insertion display data when the average gradation of the image display data is the largest gradation VGz is, for example, set to a value which falls within a range from a value substantially equal to the largest gradation BGz of the insertion display data BD to a value substantially half of such largest gradation BGz.

Further, in FIG. 6, although the gradation of the insertion display data is changed linearly from $BG_0$ to $BG_K$, the gradation takes discrete values. Still further, the gradation $BG_K$ of the insertion display data BD when the average gradation of the image display data is the largest gradation (VGz) is not set to $BG_K=BG_Z$. Accordingly, the average gradation of the image display data and the gradation of the insertion display data do not exhibit the 1:1 relationship but exhibits the h:1 relationship. That is, the average gradation of the image display data is divided into blocks for every h gradations, and the gradation $BG_Z$ (Z=0, 1, 2, . . . , k<Z) of one insertion display data is defined for every block.

Further, the gradation $BG_Z$ (Z=0, 1, 2, . . . , k<Z) of the insertion display data may be defined on the basis of an arbitrary function without being limited to such a definition.

Here, in the example shown in FIG. 5, the case in which the image display data VD of the average gradation $VG_1$ is continuously displayed, the case in which the image display data VD of the average gradation $VG_2$ is continuously displayed, and the case in which the image display data VD of the average gradation $VG_3$ is continuously displayed are shown. However, in actually displaying an image, for example, as shown in FIG. 7, the average gradation $VG_X$ of the image display data VD is changed with a lapse of time. Accordingly, when the image is actually displayed, the gradation $BG_Z$ (Z=0, 1, 2, . . . , k<Z) of the insertion display data is changed for every frame period, for example based on the average gradation $VD_Z$ of the image display data in the frame period. The motion picture blurring can be decreased in the same manner as the case in which a conventional black display data is inserted.

Here, in the embodiment 1, it is assumed that the period t1 from the point of time that the image scanning signal is outputted to the first scanning signal line $GL_1$ to the point of time that the insertion scanning signal is outputted to the first scanning signal line $GL_1$, that is, the period t2 for displaying the insertion display data in every frame period is fixed in all frame periods.

Figure 8:
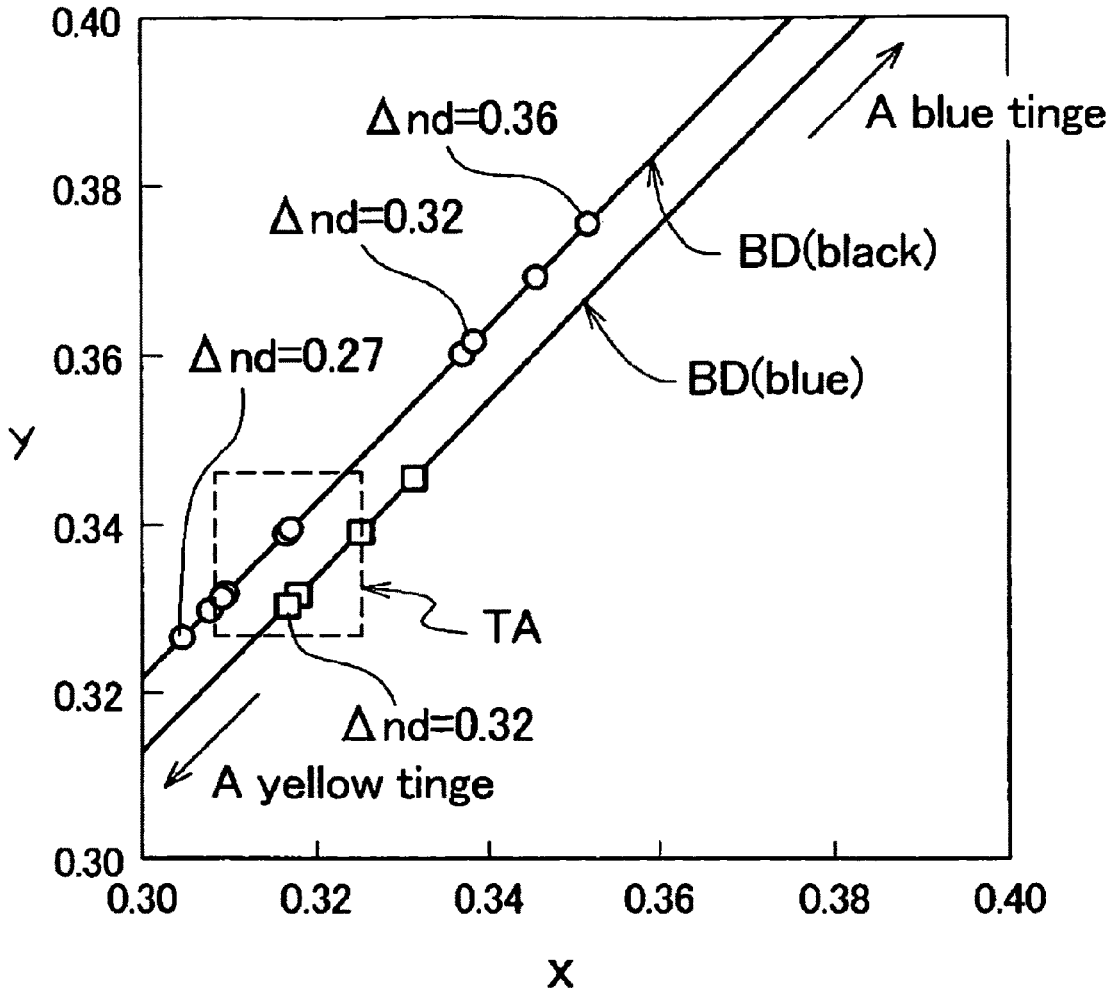
FIG. 8 is a schematic view for explaining advantageous effects of the embodiment 1 and also is a graph showing one example of the distribution of the retardation in a xy chromaticity graph.
Figure 9:
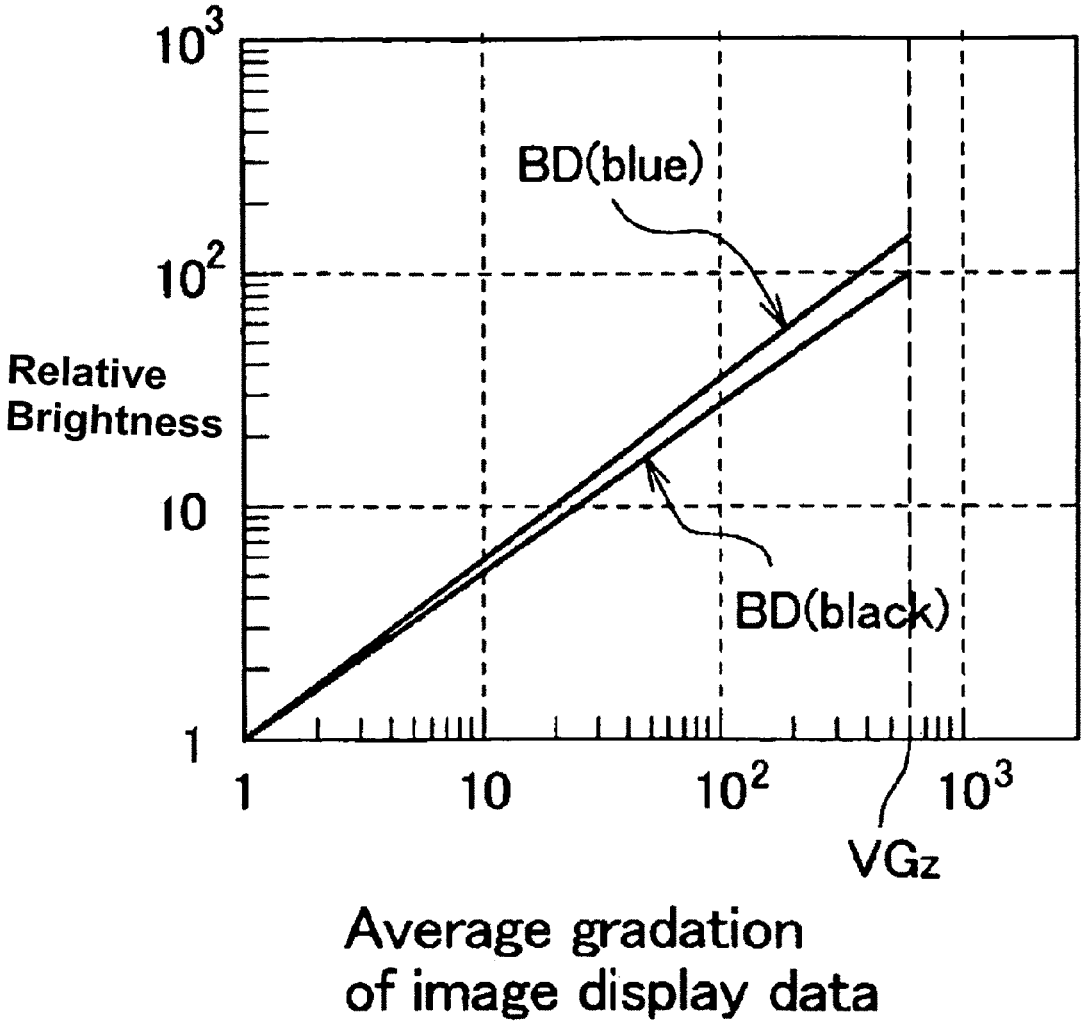
FIG. 9 is a schematic view for explaining advantageous effects of the embodiment 1 and also is a graph showing the relationship between the average gradation and the relative brightness of the image display data for 1 frame period.

FIG. 8 and FIG. 9 are schematic views for explaining advantageous effects of the embodiment 1, wherein FIG. 8 is a graph chart showing an example of the distribution of retardation Δnd distribution in an xy chromaticity diagram, and FIG. 9 is a graph chart showing the relationship between the average gradation of the image display data and the relative brightness in one frame period.

When the display method of the embodiment 1 is applied, to an IPS-type liquid crystal display device, for example, the distribution of the x value and the y value of chromaticity when the retardation Δnd of the liquid crystal layer LC of the liquid crystal display device is changed is expressed as indicated by a bold line (BD (blue)) shown in FIG. 8. In the liquid crystal display device, the optimum chromaticity region, to be more specific, a region in which the x value and the y value of chromaticity assumes desired values is a target region TA indicated by a broken line in FIG. 8. Further, in FIG. 8, for reference, the distribution of the x value and the y value of chromaticity when the retardation Δnd is changed in a display device for displaying a conventional black insertion display data is indicated by a fine line (BD (black)).

Figure 14:
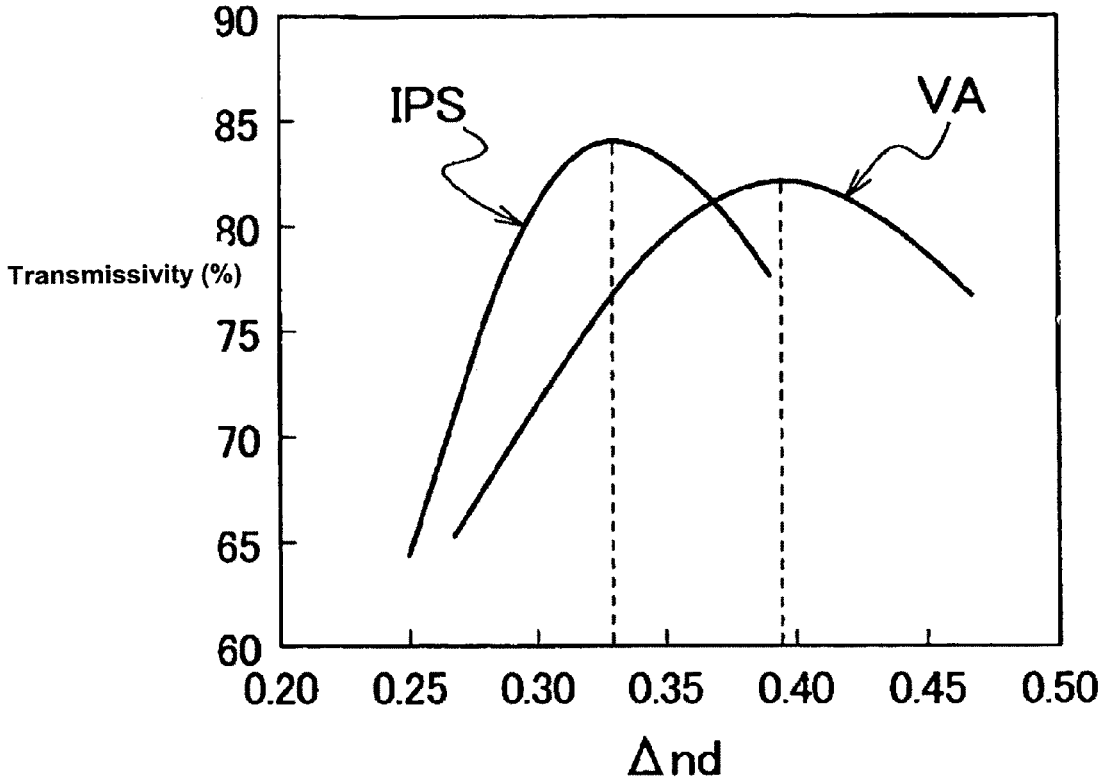
FIG. 14 is a graph showing the relationship between the retardation and the transmissivity of a liquid crystal display device.
Figure 15:
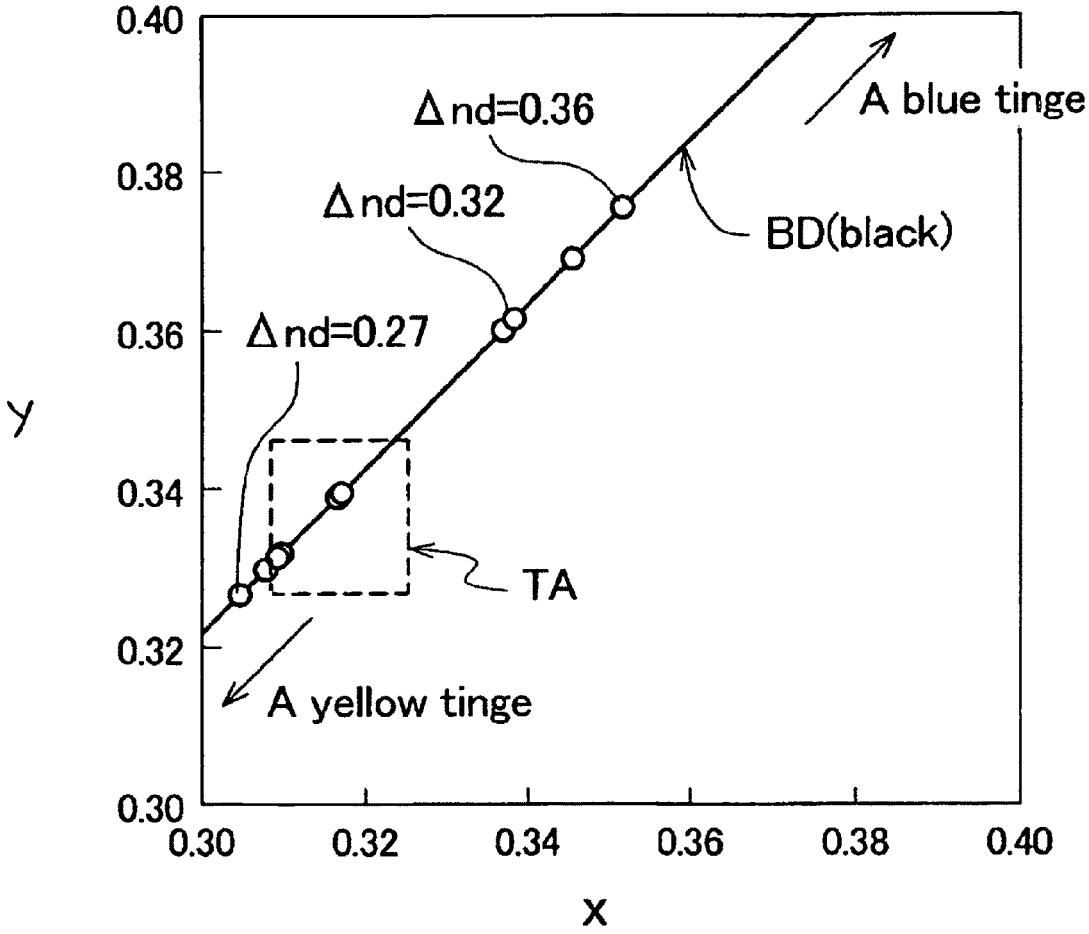
FIG. 15 is a graph showing one example of the distribution of the retardation in a xy chromaticity chart.

In the above-mentioned IPS-type liquid crystal display device, the transmissivity, that is, the brightness assumes the largest value when the retardation Δnd is in a range from approximately 0.32 to 0.34 as shown in FIG. 14. Accordingly, in the conventional display device which displays the black insertion display data, it is difficult to maximize the transmissivity and, at the same time, to set the x value and the y value of chromaticity within the target region TA.

On the other hand, when the display method of the first embodiment 1 is applied to the IPS-type liquid crystal display device, as shown in FIG. 8, the x value and the y value of chromaticity when the retardation Δnd exhibits 0.32 fall within the target region TA. Accordingly, the liquid crystal display device to which the display method of the embodiment 1 is applied can optimize the brightness characteristic and the chromaticity characteristic.

Particularly with respect to the brightness characteristic, for example, as shown in FIG. 9, compared to the conventional case in which the black insertion display data is inserted (indicated by a fine line), the relative brightness when the blue insertion display data is inserted is increased, and, the brightness is enhanced by approximately 30% when a white display is performed. Here, the higher the average gradation of the image display data displayed in one frame period, the gap of the relative brightness is increased and hence, it is possible to enhance the contrast.

Here, in the embodiment 1, although the blue display data is adopted as the insertion display data, the insertion display data may be of any other chromatic color provided that the x value and the y value of chromaticity are within the target region TA when the retardation Δnd ensures the largest transmissivity as shown in FIG. 8.

Figure 10:
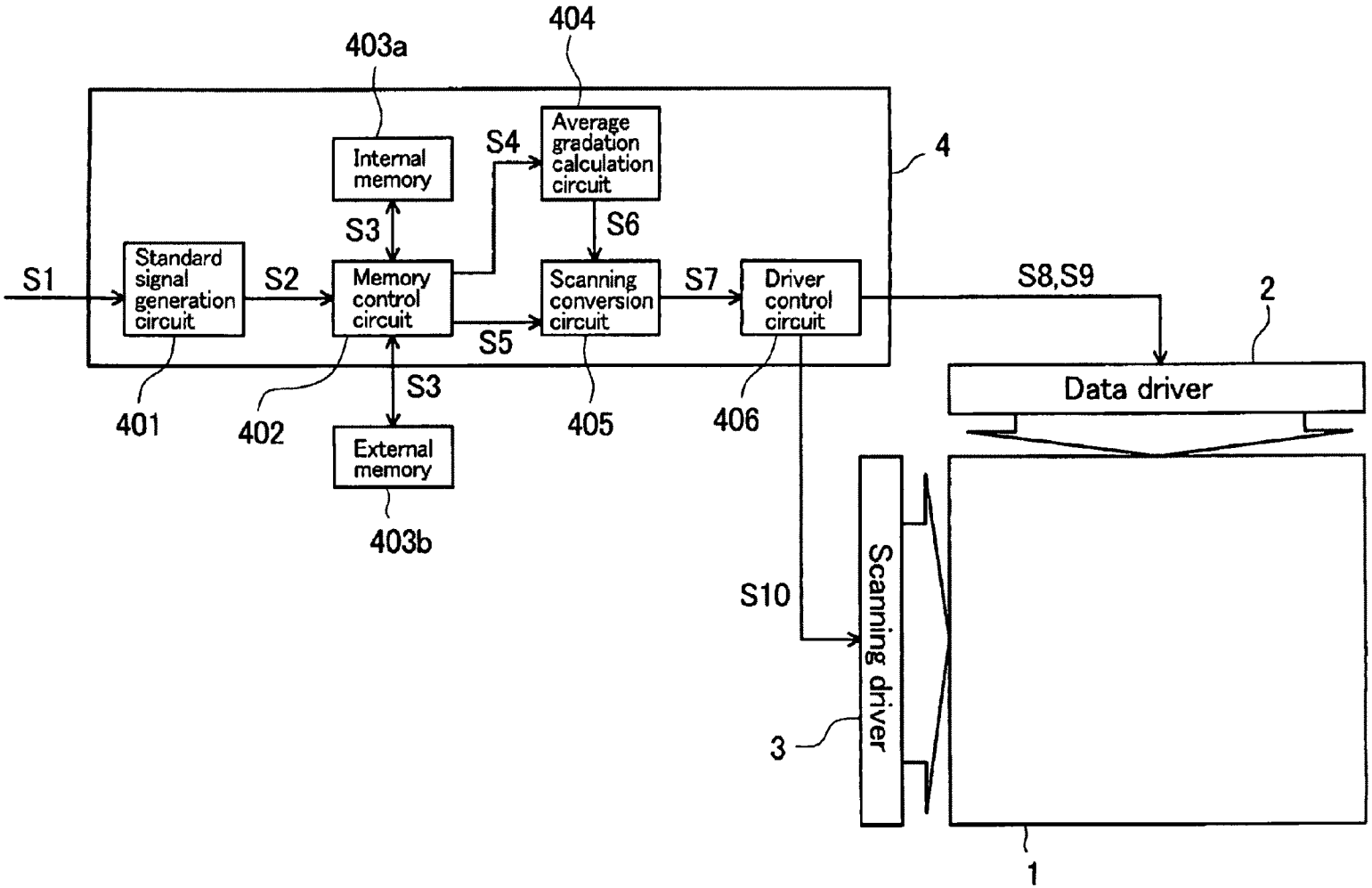
FIG. 10 is a circuit block diagram showing a constitutional example of a liquid crystal display device for embodying a display method of the embodiment 1.

FIG. 10 is a circuit block diagram showing a constitutional example of a liquid crystal display device which embodies a display method of this embodiment 1.

The liquid crystal display device of this embodiment 1 includes, as shown in FIG. 10, a liquid crystal display panel 1, a data driver 2, a scanning driver 3 and a display control circuit 4.

Here, the display control circuit 4 includes an internal reference signal generating circuit 401, a memory control circuit 402, an inner memory 403*a*, an outer memory 403*b*, an average gradation calculation circuit 404, a scanning conversion circuit 405, and a driver control circuit 406.

The internal reference signal generating circuit 401 receives a module signal S1 such as a video signal or a control signal from an external device, generates an internal reference signal S2, and transmits the internal reference signal S2 to the memory control circuit 402.

The memory control circuit 402 extracts a video signal from the internal reference signal S2, divides the video signal into video signals S3 for every frame period and stores the video signals S3 in the inner memory 403*a* or the external memory 403*b*. Further, the memory control circuit 402 supplies gradation data S4 of the video signal for 1 frame period to the average gradation calculation circuit 404. Further, the memory control circuit 402 supplies a signal S5 such as a video signal of an amount corresponding to 1 frame period or a clock signal to the scanning conversion circuit 405.

The average gradation calculation circuit 404 calculates the average gradation based on the gradation data S4 of the video signal received from the memory control circuit 402 and, thereafter, decides the gradation of the insertion display data based on a calculation result, and transmits the gradation data S6 to the scanning conversion circuit 405.

The scanning conversion circuit 405 converts the video signal amounting to 1 frame period to image display data of a desired mode based on the signal S5 received from the memory control circuit 402 and, at the same time, generates the insertion display data BD based on the gradation data S6 received from the average gradation calculation circuit 404, and inserts the insertion display data BD to the video display data. Then, the scanning conversion circuit 405 transmits signals S7 such as the image display data into which the insertion display data is inserted and a clock signal to the driver control circuit 406.

The driver control circuit 406, based on the signals S7 received from the scanning conversion circuit 405, first of all, transmits the image display data S8 into which the insertion display data is inserted, a horizontal clock signal S9 which controls output timings toward the data signal lines DL and the like to the data driver 2. Further, signals S10 such as a scanning clock signal, a scanning start signal are transmitted to the scanning driver 3.

By adopting such a constitution, the display control circuit 4 is capable of performing a display as shown in FIG. 5 and FIG. 7, for example.

Further, in case of the display control circuit 4 having the constitution shown in FIG. 10, the average gradation calculation circuit 404 may perform only the calculation of the average gradation, and the gradation of the insertion display data may be decided using the scanning conversion circuit 405.

Embodiment 2

Figure 11:
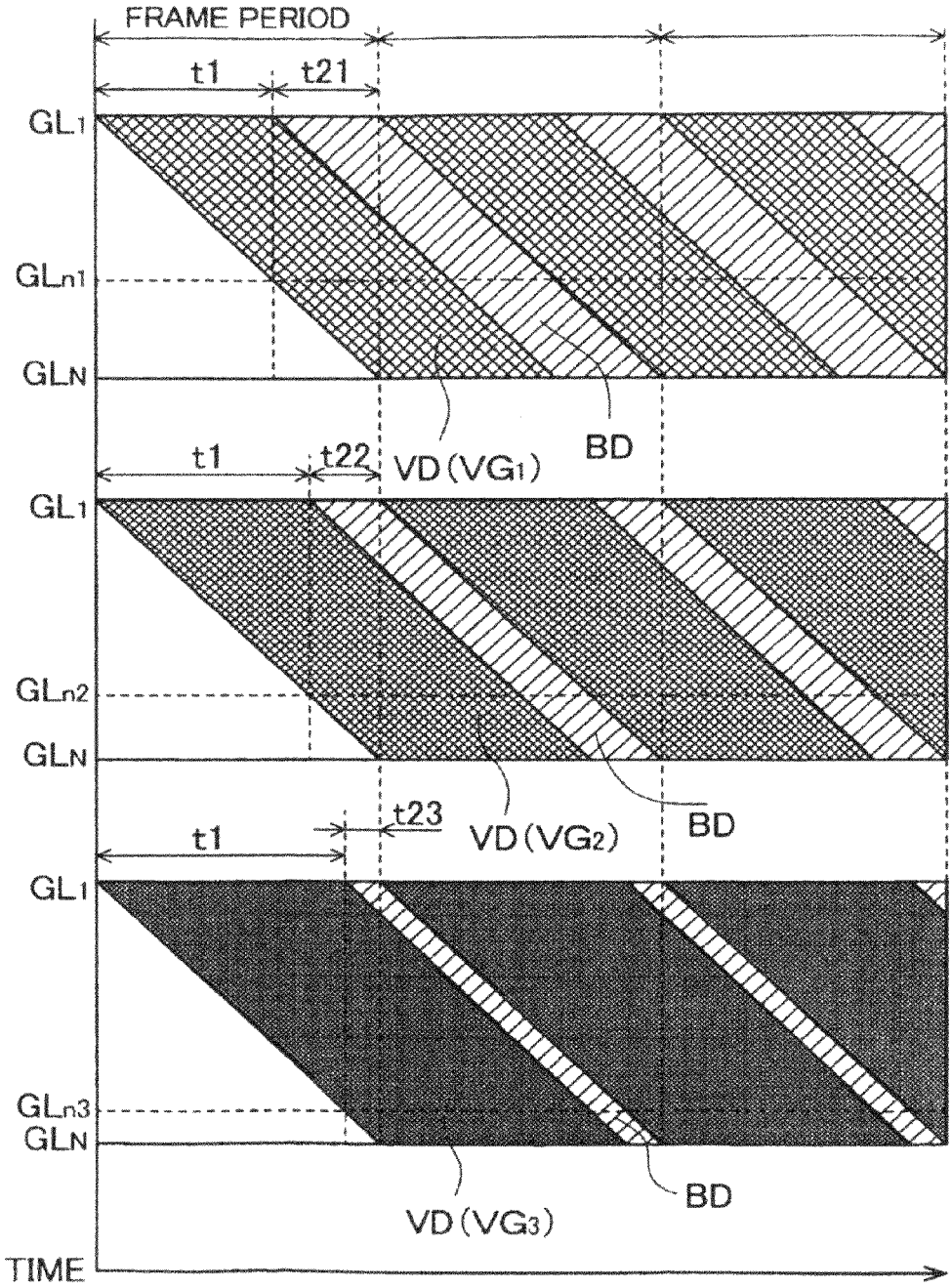
FIG. 11 is a schematic view for explaining a display method of the liquid crystal display device of an embodiment 2 according to the present invention and also is a view showing image display timing for every frame period for explaining a principle of the embodiment 2.
Figure 12:
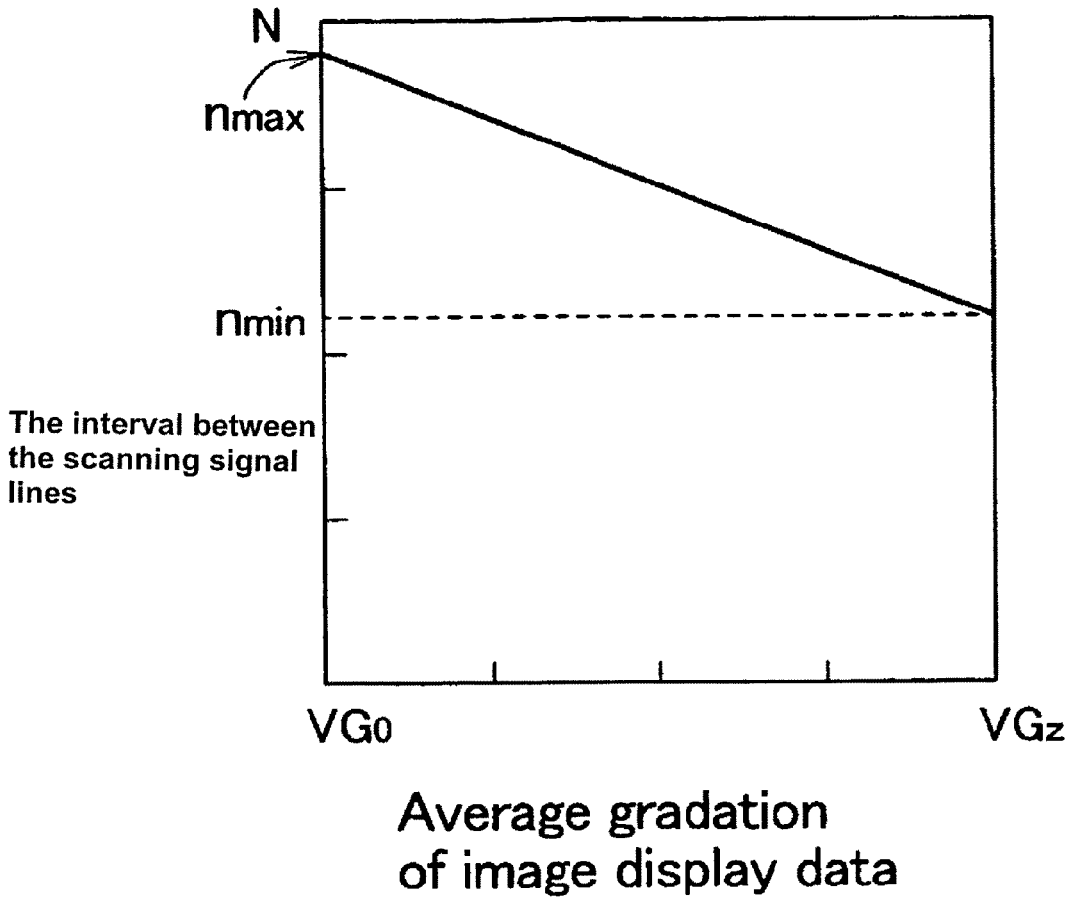
FIG. 12 is a schematic view for explaining the display method of the liquid crystal display device of the embodiment 2 according to the present invention and also is a view showing one example of a method for setting a display period of insertion display data.
Figure 13:
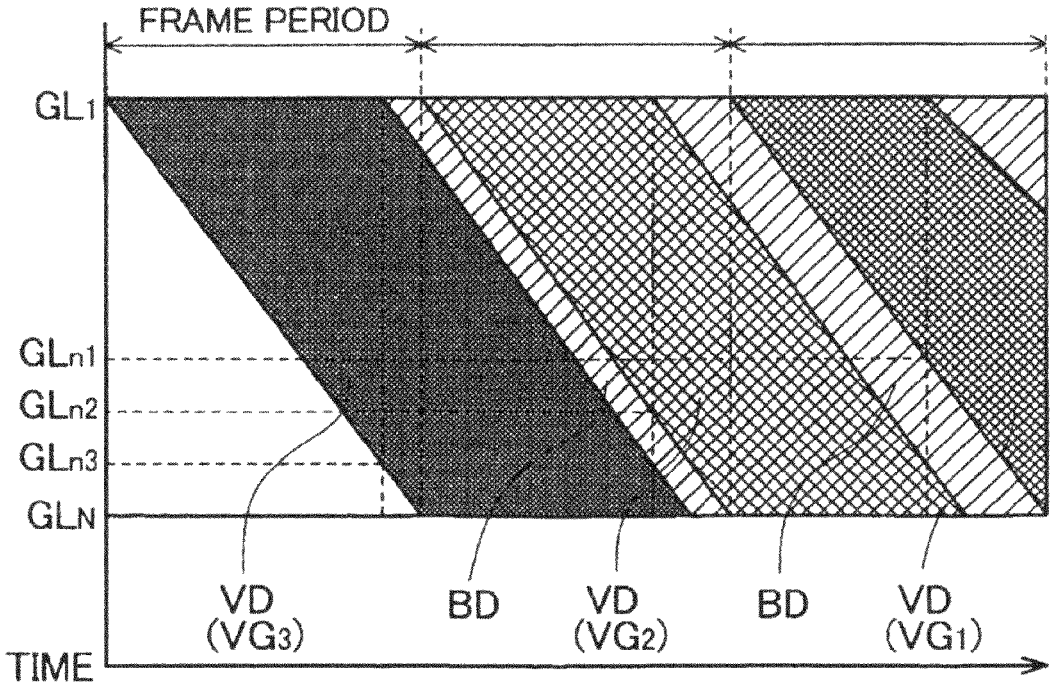
FIG. 13 is a schematic view for explaining a display method of the liquid crystal display device of the embodiment 2 according to the present invention and also is a view showing one example of image display timing for every frame period when an image is actually displayed.

FIG. 11 to FIG. 13 are schematic views for explaining a display method of a liquid crystal display device of an embodiment 2 according to the present invention, wherein FIG. 11 is a view showing image display timing for every frame period for explaining a principle of this embodiment 2, FIG. 12 is a view showing one example of a method for setting a display period of insertion display data, and FIG. 13 is a view showing one example of image display timing for every frame period when an image is actually displayed.

The display method of this embodiment 2 is a display method which can reduce motion picture blurring and can set both of the brightness characteristic and chromaticity characteristic to optimum values by coloring insertion display data BD in blue and by setting a display period t2 of the insertion display data BD for every frame period.

Here, the display period t2 of the insertion display data BD is changed, for example, as shown in FIG. 11, in response to the brightness of the image display data, to be more specific, the average gradation VG of the image display data which is displayed for every frame period. Here, FIG. 11 shows three image display timings for every frame period in parallel in the vertical direction, wherein an upper stage shows the image display timing when the average gradation of the image display data VD is $VG_1$, an intermediate stage shows the image display timing when the average gradation of the image display data VD is $VG_2$, and a lower stage shows the image display timing when the average gradation of the image display data VD is $VG_3$.

In the display method of this embodiment 2, for example, when the average gradation of the image display data VD is $VG_1$, the display period of the insertion display data BD is set to t21. Further, when the average gradation of the image display data VD is $VG_2$, the display period of the insertion display data BD is set to t22. Still further, when the average gradation of the image display data VD is $VG_3$, the display period of the insertion display data BD is set to t23.

Here, when the average gradation of the image display data VD is high, the display period of the insertion display data BD is prolonged, while when the average gradation of the image display data VD is low, the display period of the insertion display data BD is shortened. That is, in the example shown in FIG. 11, the average gradation of the image display data VD is set to a descending order of $VG_1>VG_2>VG_3$, while the display period of the insertion display data BD is set to a descending order of t21>t22>t23.

Further, in the display method of this embodiment 2, lengths of respective frame periods are set to a fixed value. This implies that in the frame period which has the long display period of the insertion display data BD, a period t1 from a point of time that the video scanning signal is outputted to the point of time that the insertion scanning signal is outputted becomes short. To the contrary, in the frame period which has the short display period for the insertion display data, the period t1 from the point of time that the video scanning signal is outputted to the point of time that the insertion scanning signal is outputted is prolonged.

Further, to explain the display method of this embodiment 2 in view of the relationship between the scanning signals lines which output the video scanning signal and the scanning signal lines which output the insertion scanning signals, for example, to display the image display data VD of the average gradation $VG_1$, in each frame period, after starting the outputting of the video scanning signal from the first scanning signal line $GL_1$, at timing that the video scanning signal is outputted to the n1-th scanning signal line $GL_{n1}$, the insertion scanning signal is outputted to the first scanning signal line $GL_1$. Further, to display the image display data VD of the average gradation $VG_2$, in each frame period, after starting the outputting of the video scanning signal from the first scanning signal line $GL_1$, at timing that the video scanning signal is outputted to the n2-th scanning signal line $GL_{n2}$, the insertion scanning signal is outputted to the first scanning signal line $GL_1$. Further, to display the image display data VD of the average gradation $VG_3$, in each frame period, after starting the outputting of the video scanning signal from the first scanning signal line $GL_1$, at timing that the video scanning signal is outputted to the n3-th scanning signal line $GL_{n3}$, the insertion scanning signal is outputted to the first scanning signal line $GL_1$.

Here, the average gradation of the image display data VD is set to a descending order of $VG_1>VG_2>VG_3$, while at a point of time that the insertion scanning signal is outputted to the first scanning signal line $GL_1$, the number of the scanning signal line to which the video scanning signal is outputted is set to a descending order of n3>n2>n1. That is, in the display method of this embodiment 2, in response to the average gradation of the image display data VD, a distance between the first scanning signal line $GL_1$ and the scanning signal line which outputs the video scanning signal at a point of time that the insertion scanning signal is outputted to the first scanning signal line $GL_1$ is changed. Here, when the average gradation of the image display data VD is high, the above-mentioned distance between the scanning signal lines is narrow, while when the average gradation of the image display data VD is low, the distance between the scanning signal lines is widened.

Further, in FIG. 11, although the case in which three average gradations of the image display data VD are adopted is illustrated, in an actual operation, the number of average gradations corresponding to the number of displayable gradations exists. Accordingly, the average gradation of the insertion display data and the display period t2 of the insertion display data BD are, for example, as shown in FIG. 12, defined by the average gradation of the image display data and an interval between the scanning signal lines. FIG. 12 is a graph chart in which the average gradation of the image display data displayed in one frame period is taken on an axis of abscissas and the interval between the scanning signal lines is taken on an axis of ordinates. Further, the interval between the scanning signal lines in FIG. 12 is the interval between the first scanning signal line $GL_1$ and the scanning signal line outputting the image scanning signal at a point of time that the insertion scanning signal is outputted to the first scanning signal line $GL_1$ in every frame period.

Assuming that the respective pixels of the liquid crystal display device can perform the display of Z+1 gradations, the average gradation of the image display data VD exhibits any one of the gradations of VGz(z=0, 1, 2, . . . , Z). Accordingly, as shown in FIG. 12, for example, when the average gradation of the image display data VD assumes the smallest gradation ($VG_0$), the interval between the scanning signal lines is set to $n_{max}$, while when the average gradation of the image display data assumes the largest gradation (VGz), the interval between the scanning signal lines is set to $n_{min}$. Further, by changing the interval between the scanning signal lines linearly within a range from $n_{max}$ to $n_{min}$, when the average gradation VG of the image display data VD is high, the display period t2 of the insertion display data BG is prolonged, while when the average gradation VG is low, the display period t2 of the insertion display data BD is set shortened.

Here, the interval $n_{min}$ between the scanning signal lines when the average gradation of the image display data assumes the largest gradation (VGz) is set to satisfy the relationship $n_{min}>N/2$ by assuming the total number of the scanning signal lines as N.

Further, in FIG. 12, although the interval between the scanning signal lines is linearly changed from $n_{max}$ to $n_{min}$, the change of the interval is not limited to such a case and the interval between the scanning signal lines may be changed in a step-like manner using a step function, for example. That is, the average gradation of the image display data may be divided into a plurality of blocks and one interval may be defined of each block.

Further, the gradation of the insertion display data may be defined on the basis of an arbitrary function without being limited to such a definition.

Here, in the examples shown in FIG. 12, the case in which the image display data VD having the average gradation $VG_1$ is continuously displayed, the case in which the image display data VD having the average gradation $VG_2$ is continuously displayed, and the case in which the image display data VD having the average gradation $VG_3$ is continuously displayed are shown. However, when an image is actually displayed, for example, as shown in FIG. 13, the average gradation $VG_z$ of the image display data VD is changed along with a lapse of time. Accordingly, when the image is actually displayed for every period, for example, the display period of the insertion display data, that is, the interval between the scanning signal lines is changed based on the average gradation of the image display data VD in the frame period. Accordingly, the motion picture blurring can be decreased in the same manner as the case in which the conventional black display data is inserted.

Further, although the detailed explanation is omitted, also when the display method of the embodiment 2 is applied to the IPS-type liquid crystal display device, the x value and the y value of chromaticity when the retardation Δnd of the liquid crystal layer LC of the liquid crystal display device is changed, exhibits the distribution indicated by a bold line (BD (blue)) in FIG. 8. Accordingly, also in the liquid crystal display device to which the display method of the embodiment 2 is applied, the brightness characteristic and the chromaticity characteristic can be optimized.

Further, also in the embodiment 2, although the blue display data is adopted as the insertion display data, the insertion display data may be of any other chromatic color provided that the x value and the y value when of the retardation Δnd provides the largest transmissivity are within the target region TA shown in FIG. 8.

Further, the constitution of the liquid crystal display device which embodies the display method of the embodiment 2, may be constituted as shown in FIG. 10, for example. However, in the display method of the embodiment 2, timing at which the insertion scanning signal is outputted the first scanning signal line $GL_1$ is set for every frame period. Accordingly, the above-mentioned average gradation calculation circuit 404, after calculating the average gradation, determines the interval between the scanning signal lines in accordance with the definition shown in FIG. 12, for example. Then, the average gradation calculation circuit 404 transmits data indicative of the interval between the scanning signal lines to a scanning conversion circuit 405 in place of the gradation data S6 used in the above-mentioned embodiment 1.

Further, in the above-mentioned driver control circuits 406, the circuit which transmits signals S10 such as a scanning clock signal and a scanning starting signal to the scanning driver 3 outputs a signal which controls timing for outputting the insertion scanning signal in addition to the above mentioned respective signals.

By providing such a constitution to the display control circuit 4, for example, the displays shown in FIG. 11 and FIG. 13 can be acquired.

Further, when the display control circuit 4 having the constitution shown in FIG. 10 is adopted, the average gradation calculation circuit 404 may perform only the calculation of the average gradation so as to allow the scanning conversion circuit 405 to decide the interval between the scanning signal lines.

Although the present invention has been explained specifically in conjunction with the above-mentioned embodiments heretofore, it is needless to say that the present invention is not limited to the above-mentioned embodiments and various modifications can be made without departing from the gist of the present invention.

For example, in the above-mentioned embodiment 1, the display method for changing the gradation BG of the insertion display data BD is explained, while in the above-mentioned embodiment 2, the display method for changing the display period t2 of the insertion display data BD is explained. However, it is needless to say that the display method of the present invention is not limited to either one of the display methods and, for example, the combination of the display method of the embodiment 1 and the display method of the embodiment 2, that is, the display method which changes the gradation BG of the insertion display data BD as well as the display period t2 may be adopted.

What is claimed is:

1. A liquid crystal display device comprising:

a liquid crystal display panel in which a plurality of data signal lines and a plurality of scanning signal lines are arranged in a matrix array and in which a plurality of pixel regions are each formed in a respective region surrounded by two neighboring data signal lines of the plurality of data signal lines and two neighboring scanning signal lines of the plurality of data signal lines;

a data driver which outputs a display signal to the plurality of data signal lines;

a scanning driver which outputs a scanning signal to the plurality of scanning signal lines; and a display control circuit which controls the scanning driver, wherein the display control circuit includes:

a first circuit which divides image display data inputted from an external device for each frame period, generates insertion display data for each frame period which differs from the image display data, and transmits the image display data inputted from the external device to the data driver with the insertion display data inserted between the image display data, and a second circuit which sets a first time at which the scanning signal for displaying the image display data inputted from the external device is outputted to the respective scanning signal lines and a second time at which the scanning signal for displaying the insertion display data is outputted to the respective scanning signal lines, and wherein the first circuit sets gradations of chromatic color for every frame period when generating the insertion display data, wherein the first circuit sets the gradations when generating the insertion display data based on an average gradation of the image display data for each frame period, and wherein the first circuit generates and inserts blue insertion display data between the image display data.

2. A liquid crystal display device according to claim 1, wherein the first circuit increases the gradations of the insertion display data when the average gradation has high gradation data, and decreases the gradation of the insertion display data when the average gradation has low gradation data.

* * * * *